US006711910B2

(12) United States Patent
Ziolkowski et al.

(10) Patent No.: US 6,711,910 B2
(45) Date of Patent: Mar. 30, 2004

(54) QUIET ICE MAKING APPARATUS

(75) Inventors: Daniel Leo Ziolkowski, Lake Barrington, IL (US); Matthew W. Allison, Mundelein, IL (US); David Brett Gist, Grayslake, IL (US)

(73) Assignees: Mile High Equipment Co., Denver, CO (US); Scotsman Ice Systems, Vernon Hills, IL (US)

( * ) Notice: Subject to any disclaimer, the term of this patent is extended or adjusted under 35 U.S.C. 154(b) by 7 days.

(21) Appl. No.: 10/374,833

(22) Filed: Feb. 26, 2003

(65) Prior Publication Data

US 2003/0126877 A1 Jul. 10, 2003

Related U.S. Application Data

(62) Division of application No. 09/952,143, filed on Sep. 14, 2001.

(60) Provisional application No. 60/233,392, filed on Sep. 15, 2000.

(51) Int. Cl.[7] ..... F25B 41/00

(52) U.S. Cl. ..... 62/196.4; 62/278

(58) Field of Search ..... 62/196.4, 277, 62/278, 81

(56) References Cited

U.S. PATENT DOCUMENTS

| | | | | | |
|---|---|---|---|---|---|
| 4,171,622 | A | * | 10/1979 | Yamaguchi et al. | 62/160 |
| 4,688,392 | A | * | 8/1987 | Fujimoto et al. | 62/174 |
| 4,735,059 | A | * | 4/1988 | O'Neal | 62/196.4 |
| 4,850,197 | A | * | 7/1989 | Taylor et al. | 62/81 |
| 4,854,130 | A | * | 8/1989 | Naruse et al. | 62/352 |
| 5,056,327 | A | * | 10/1991 | Lammert | 62/151 |

* cited by examiner

*Primary Examiner*—William E. Tapolcai
(74) *Attorney, Agent, or Firm*—Ohlandt, Greeley, Ruggiero & Perle, LLP

(57) ABSTRACT

An ice cube-making machine that is characterized by noiseless operation at the location where ice cubes are dispensed and be lightweight packages for ease of installation. The ice cube-making machine has an evaporator package, a separate compressor package and a separate condenser package. Each of these packages has a weight that can generally by handled by one or two installers for ease of installation. The noisy compressor and condenser packages can be located remotely of the evaporator package. The maximum height distance between the evaporator package and the condenser package is greatly enhanced by the three package system. A pressure regulator operates during a harvest cycle to limit flow of refrigerant leaving the evaporator, thereby increasing pressure and temperature of the refrigerant in the evaporator and assisting in defrost thereof.

8 Claims, 6 Drawing Sheets

QUIET ICE MAKING APPARATUS

This Application is a division of, and claims priority in, co-pending U.S. patent application Ser. No. 09/952,143, filed Sep. 14, 2001, which claims the benefit of U.S. Provisional Application No. 60/233,392, filed Sep. 15, 2000, the disclosures of which are incorporated herein by reference.

FIELD OF INVENTION

This invention relates to an ice cube-making machine that is quiet at the location where ice is dispensed.

BACKGROUND OF INVENTION

Ice cube-making machines generally comprise an evaporator, a water supply and a refrigerant/warm gas circuit that includes a condenser and a compressor. The evaporator is connected to the water supply and to a circuit that includes the condenser and the compressor. Valves and other controls control the evaporator to operate cyclically in a freeze mode and a harvest mode. During the freeze mode, the water supply provides water to the evaporator and the circuit supplies refrigerant to the evaporator to cool the water and form ice cubes. During the harvest mode, the circuit converts the refrigerant to warm gas that is supplied to the evaporator, thereby warming the evaporator and causing the ice cubes to loosen and fall from the evaporator into an ice bin or hopper.

When installed in a location, such as a restaurant, where a small footprint is needed, ice making machines have been separated into two separate packages or assemblies. One of the packages contains the evaporator and the ice bin and is located within the restaurant. The other package contains the compressor and condenser, which are rather noisy. This package is located remotely from the evaporator, for example, outside the restaurant on the roof. The evaporator package is relatively quiet as the condenser and compressor are remotely located.

This two package ice cube-making machine has some drawbacks. It is limited to a maximum height distance of about 35 feet between the two packages because of refrigerant circuit routing constraints. Additionally, the compressor/condenser package weighs in excess of about 250 pounds and requires a crane for installation. Furthermore, service calls require the mechanic to inspect and repair the compressor/condenser package in the open elements, since it is typically located on the roof of a building. Due to inclement weather, it would be highly desirable to be able to work on the compressor in doors, since it is only the condenser that requires venting to the atmosphere.

During harvest mode, the condenser is bypassed so that refrigerant is supplied from the compressor in vapor phase to the evaporator. When the compressor is located a distance from the evaporator, the refrigerant tends to partially change to liquid phase as it traverses the distance, thereby affecting the efficiency warming or defrosting the evaporator. One prior art solution to this problem uses a heater to heat the vapor supply line. Another prior art solution locates a receiver in the same package as the evaporator and uses the vapor ullage of the receiver to supply vapor to the evaporator. Both of these solutions increase the size of the package and, hence, its footprint in a commercial establishment.

Thus, there is a need for a quiet ice cube-making machine that has a larger height distance between the evaporator and the condenser and a lighter weight for installation without the need for a crane.

There is also a need for an efficient way of providing vapor to an evaporator during harvest mode.

SUMMARY OF INVENTION

The ice cube-making machine of the present invention satisfies the first need with a three package system. The condenser, compressor and evaporator are located in separate ones of the packages, thereby reducing the weight per package and eliminating the need for a crane during installation. The compressor package can be located up to 35 feet in height from the evaporator package. For example, the evaporator package can be located in a restaurant room where the ice cubes are dispensed and the compressor package can be located in a separate room on another floor of the building, such as a utility room. This allows for service thereof to be made indoors, rather than outdoors as required by prior two package systems. The condenser package can be located up to 35 feet in height from the compressor package. For example, the condenser package can be located on the roof of the multistory building.

The evaporator package has a support structure that supports the evaporator. The compressor package has a support structure that supports the compressor. The condenser package has a support structure that supports the condenser.

The present invention satisfies the need for providing vapor to the evaporator during harvest mode by increasing the pressure and temperature of the refrigerant in the evaporator. This is accomplished by connecting a pressure regulator in circuit with the return line between the evaporator and the compressor. The pressure regulator limits flow, which increases pressure and temperature of the refrigerant in the evaporator. To achieve a small footprint of the evaporator package, the pressure regulator can be located in the compressor package.

BRIEF DESCRIPTION OF DRAWING

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
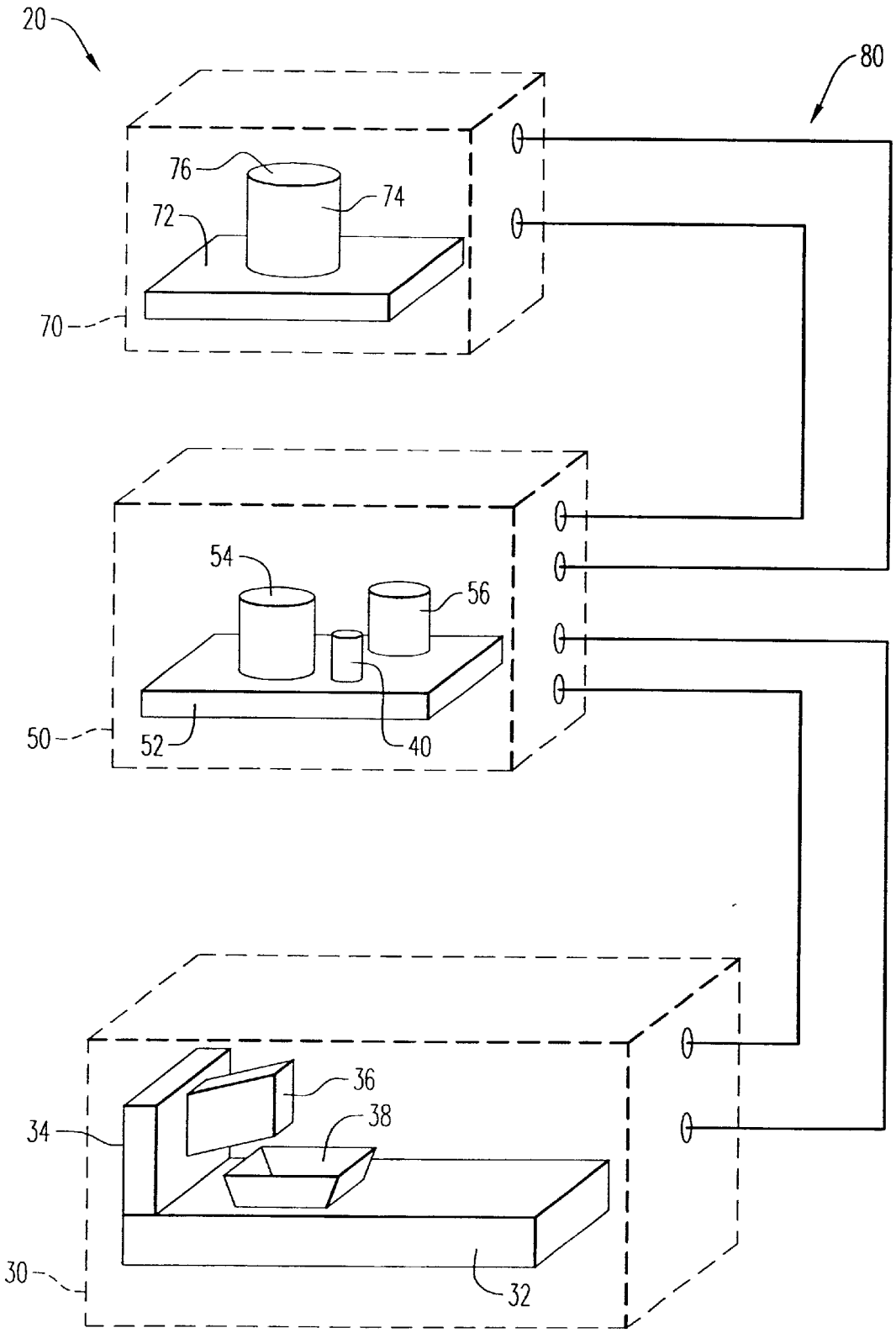
FIG. 1 is a perspective view, in part, and a block diagram, in part, of the quiet ice cube-making machine of the present invention.

Referring to FIG. 1, an ice cube-making machine 20 of the present invention includes an evaporator package 30, a compressor package 50, a condenser package 70 and an interconnection structure 80. Evaporator package 30 includes a support structure 32 that has an upwardly extending member 34. An evaporator 36 is supported by support structure 32 and upwardly extending member 34. An ice bin or hopper 38 is disposed beneath evaporator 36 to receive ice cubes during a harvest mode.

Compressor package 50 includes a support structure 52 upon which is disposed a compressor 54, an accumulator 56 and a receiver 40. Condenser package 70 includes a support structure 72 upon which is disposed a condenser 74 and a fan 76. It will be appreciated by those skilled in the art that support structures 32, 52 and 72 are separate from one another and may take on different forms and shapes as dictated by particular design requirements. It will be further appreciated by those skilled in the art that evaporator package 30, compressor package 50 and condenser package 70 suitably include various valves and other components of an ice cube-making machine.

Interconnection structure 80 connects evaporator 36, compressor 54 and condenser 74 in a circuit for the circulation of refrigerant and warm gas. Interconnection structure 80 may suitably include pipes or tubing and appropriate joining junctions.

Figure 2:
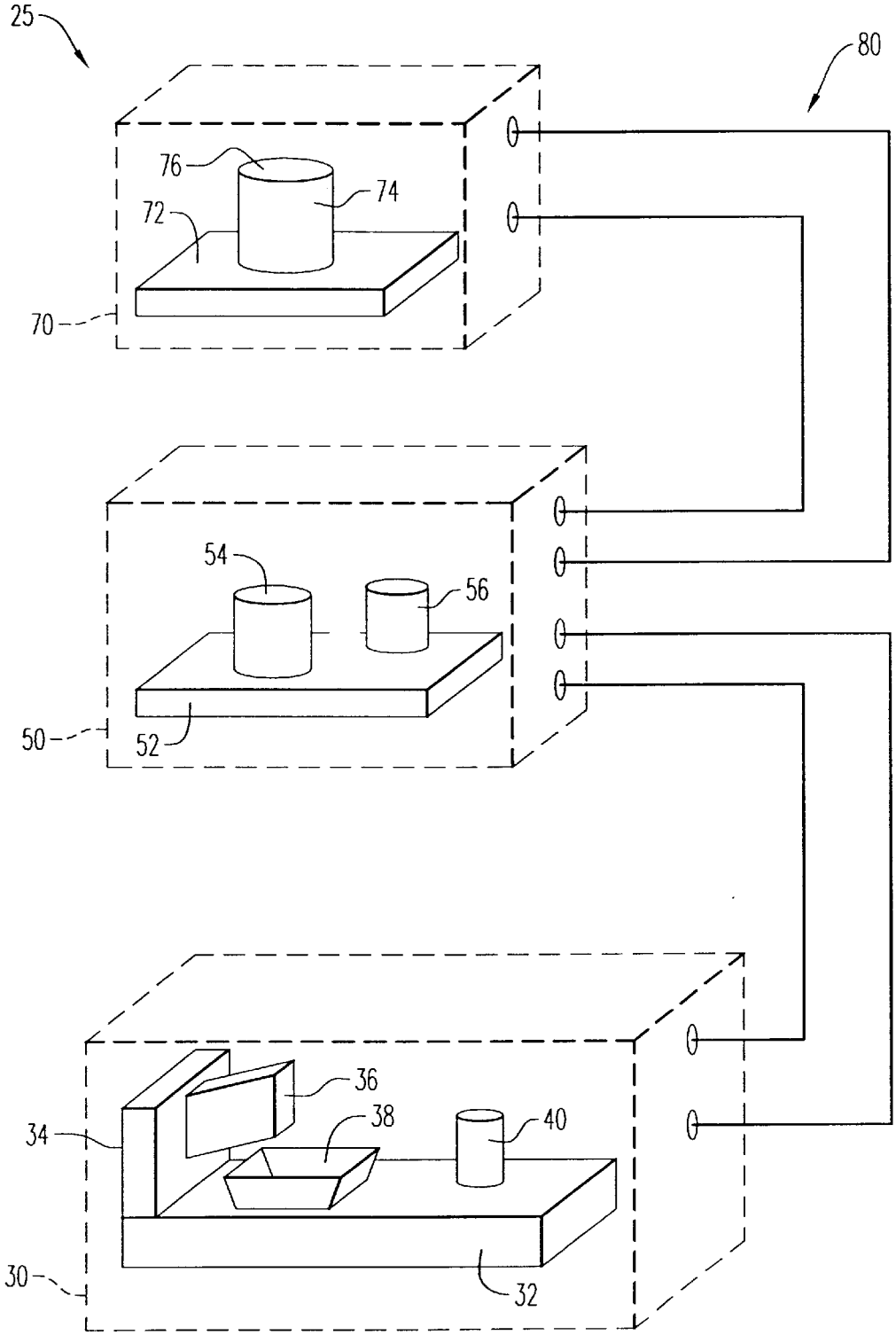
FIG. 2 is a perspective view, in part, and a block diagram, in part, of an alternative embodiment of the quiet ice cube-making machine of the present invention.

Referring to FIG. 2, an ice-making machine 25 is identical in all respects to ice making machine, except that receiver 40 is disposed on support structure 32 in evaporator package 30 rather than in compressor package 50.

Figure 3:
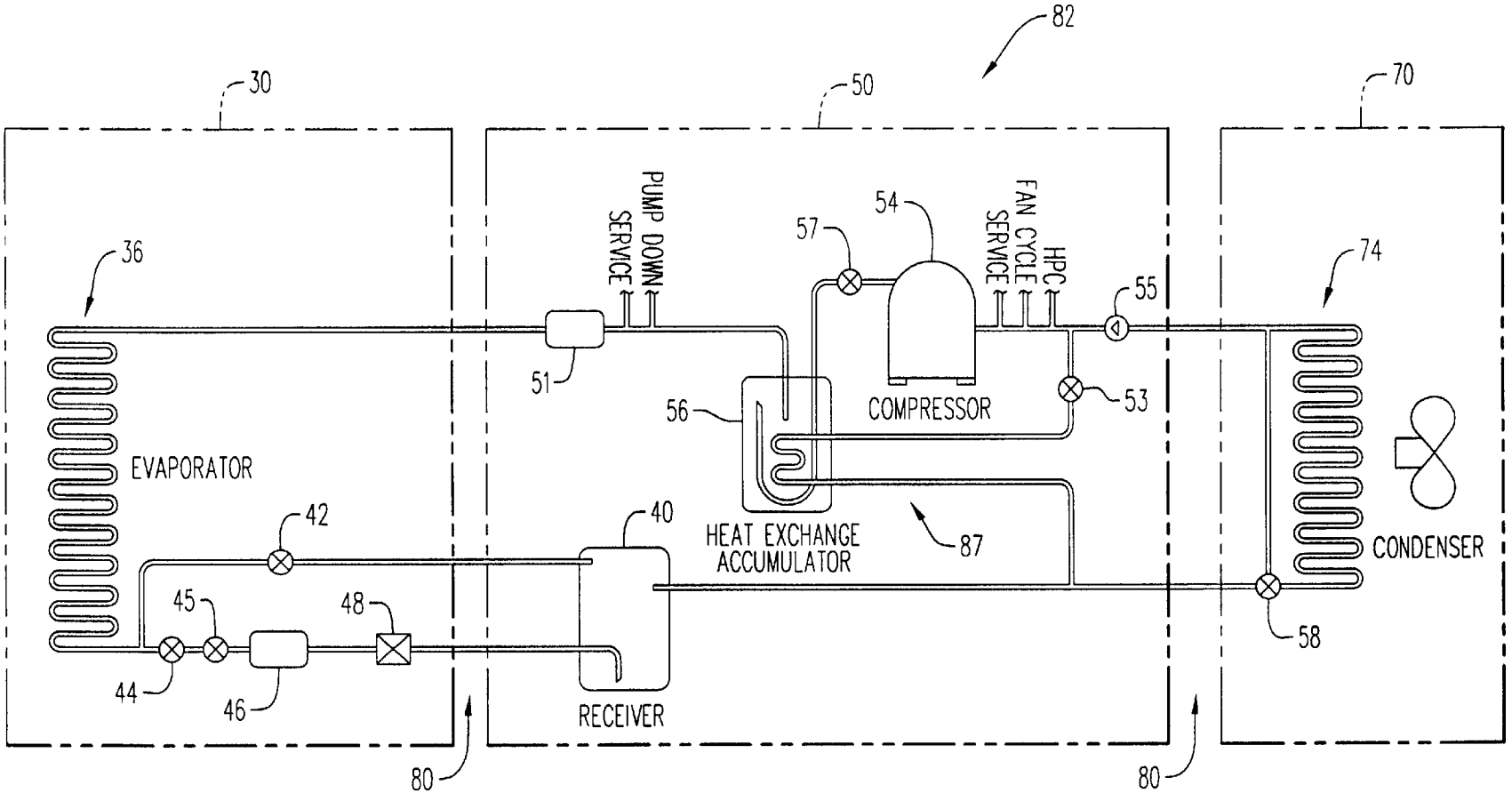
FIG. 3 is a circuit diagram of a refrigerant/warm gas circuit that can be used for the quiet ice cube-making machine of FIG. 1.

Referring to FIG. 3, a circuit 82 is shown that may be used with the FIG. 1 ice cube-making machine. Circuit 82 includes interconnection structure 80 that connects the components within compressor package 50 to the components within evaporator package 30 and to the components within condenser package 70. In evaporator package 30, evaporator 36 is connected in circuit 82 with a defrost valve 42, an expansion valve 44, a liquid line solenoid valve 45, a drier 46 and an isolation valve 48. In compressor package 50, receiver 40, compressor 54 and accumulator 56 are connected in circuit 82 with a filter 51, a bypass valve 53, a check valve 55 and an output pressure regulator 57. In condenser package 70, condenser 74 is connected in circuit 82 with a head pressure control valve 58. Head pressure control valve 58 may alternatively be placed in compressor package 50. It will be appreciated by those skilled in the art that evaporator package 30, compressor package 50 and condenser package 70 may include other valves and controls for the operation of ice cube-making machine 20. A heat exchanger loop 87 is in thermal relationship with the liquid refrigerant in accumulator so as to optimize the use thereof during the freeze cycle.

Figure 4:
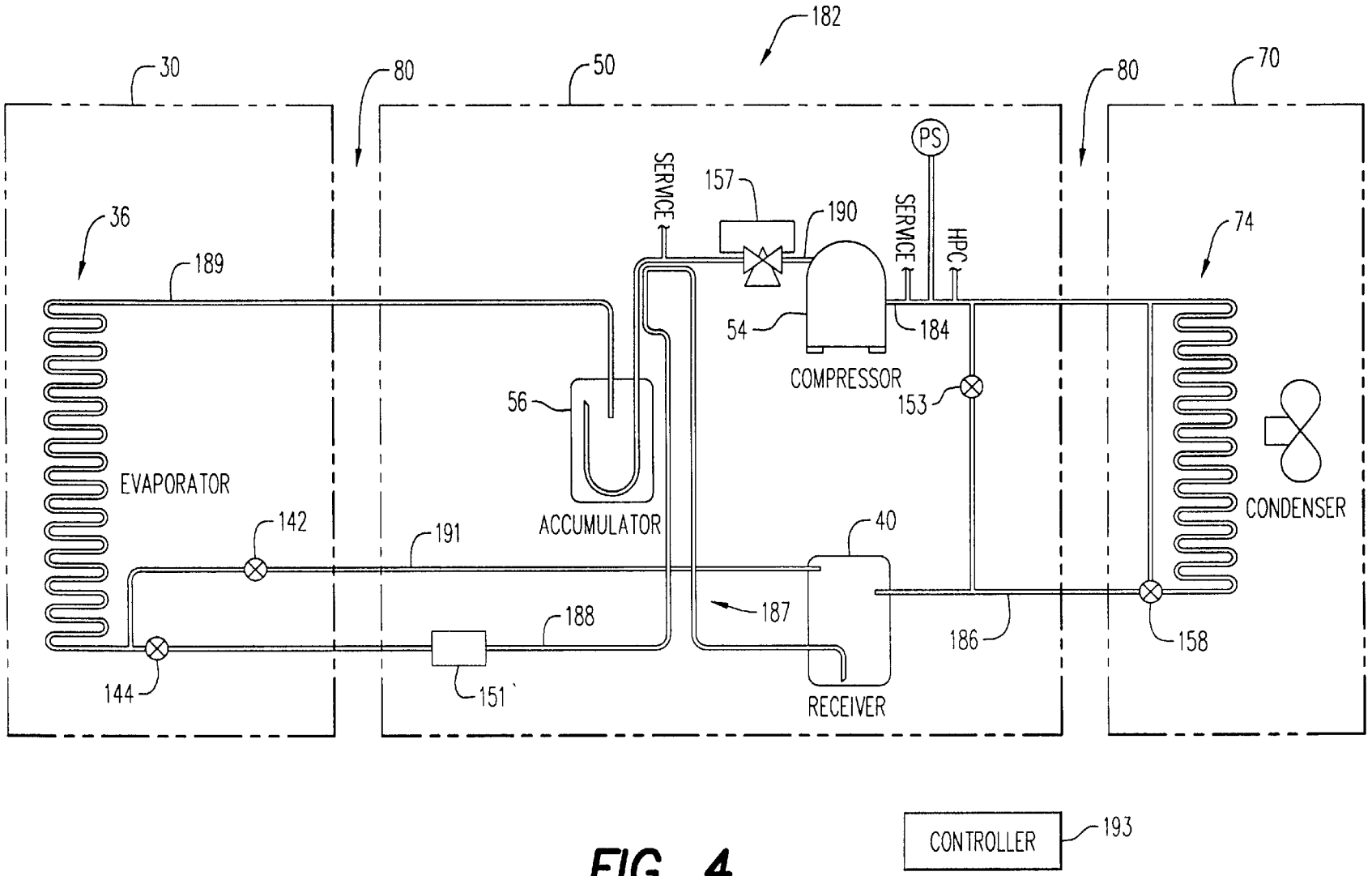
FIG. 4 is a circuit diagram of an alternative refrigerant/warm gas circuit that can be used for the quiet ice cube-making machine of FIG. 1.

Referring to FIG. 4, a circuit 182 is shown that may be used with ice cube-making machine 20 of FIG. 1. Circuit 182 includes interconnection structure 80 that connects the components within compressor package 50 to the components within evaporator package 30 and to the components within condenser package 70. In evaporator package 30, evaporator 36 is connected in circuit 182 with a defrost or cool vapor valve 142 and an expansion valve 144. In compressor package 50, receiver 40, compressor 54 and accumulator 56 are connected in circuit 182 with a filter 151, a bypass valve 153 and an output pressure regulator 157. In condenser package 70, condenser 74 is connected in circuit 182 with a head master or head pressure control valve 158. A heat exchanger loop 187 is in thermal relationship with an output tube of accumulator 56 to optimize the use of liquid refrigerant in the accumulator during the freeze cycle.

It will be appreciated by those skilled in the art that evaporator package 30, compressor package 50 and condenser package 70 may include other valves and controls for the operation of ice cube-making machine 20. For example, ice-making machine 20 includes a controller 193 that controls the operations thereof including the activation of bypass solenoid valve 153 during the harvest cycle. Alternatively, a pressure switch 192 during harvest mode can activate solenoid valve 153.

According to a feature of the present invention output pressure valve 157 operates to raise pressure and temperature of the refrigerant in evaporator 36 during ice harvesting.

During a freeze cycle, cool vapor valve 142 and bypass valve 153 are closed and expansion valve 144 is open. Refrigerant flows from an output 184 of compressor 54 via a line 185, condenser 74, head pressure control valve 158, a line 186, receiver 40. Flow continues via heat exchanger loop 187, a supply line 188, filter 151, expansion valve 144, evaporator 36, a return line 189, accumulator 56, output pressure regulator 157 to an input 190 of compressor 54. Output pressure regulator 157 is wide open during the freeze cycle such that the refrigerant passes without any impact on flow.

During a harvest cycle, cool vapor valve 142 and bypass valve 153 are open and expansion valve 144 is closed. Refrigerant in vapor phase flows from the output of compressor 54 via either or both of bypass valve 153 or head pressure valve 158 through line 186 to receiver 40. Flow continues via a vapor line 191, cool vapor valve 142, evaporator 36, return line 189, accumulator 56, output pressure regulator 157 to input 190 of compressor 54.

Output pressure regulator 157 operates during harvest to slow the flow and decrease pressure at input 190 to compressor 54. This results in a higher pressure in evaporator 36 and higher temperature of the vapor in evaporator 36. The higher temperature refrigerant in evaporator 36 enhances the harvest cycle.

Output pressure regulator 157 may be any suitable pressure regulator that is capable of operation at the pressure required in ice-making systems. For example, output pressure regulator may be Model No. OPR 10 available from Alco.

Figure 5:
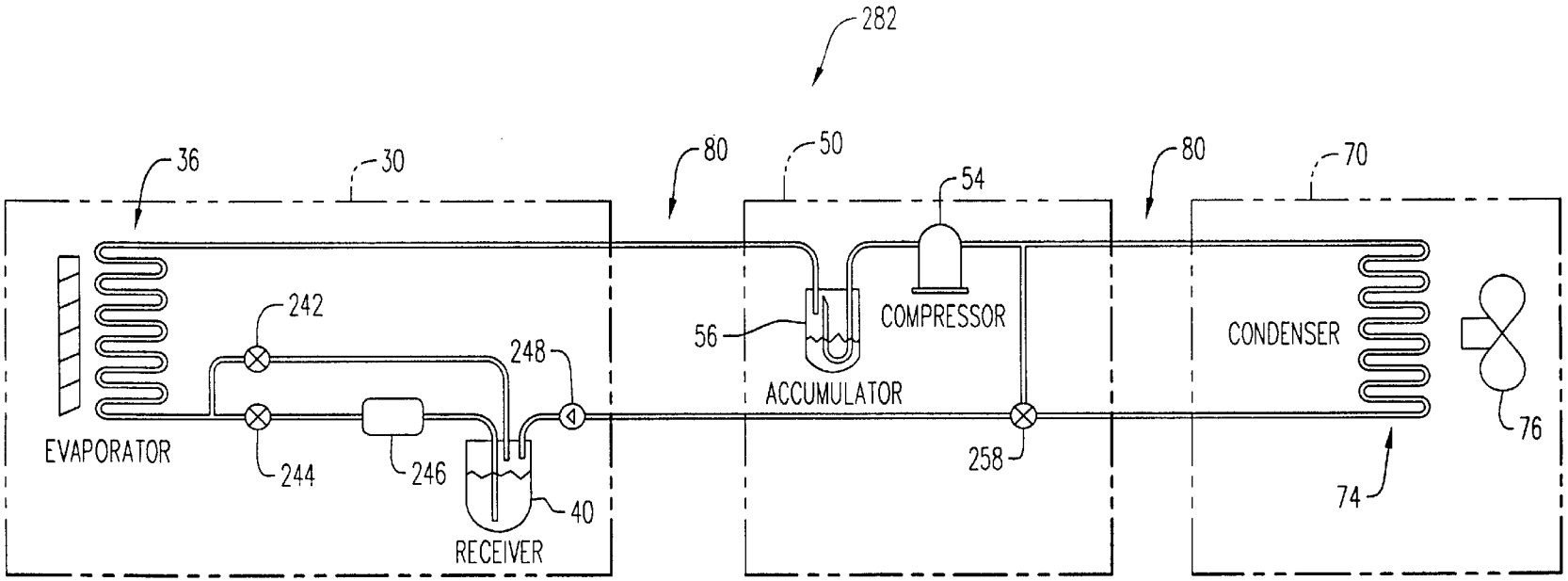
FIG. 5 is a circuit diagram of an alternative refrigerant/warm gas circuit that can be used for the quiet ice cube-making machine of FIG. 2.

Referring to FIG. 5, a circuit 282 is shown that may be used with ice cube-making machine 25 of FIG. 2. Circuit 282 includes interconnection structure 80 that connects the components within compressor package 50 to the components within evaporator package 30 and to the components within condenser package 70. In evaporator package 30, evaporator 36 and receiver 40 are connected in circuit 282 with a defrost valve 242, an expansion valve 244, a drier 246 and a check valve 248. In compressor package 50, compressor 54 and accumulator 56 are connected in circuit 282 with a head pressure control valve 258. In condenser package 70, condenser 74 is connected in circuit 282. Head pressure control valve 258 may alternatively be placed in condenser package 70. It will be appreciated by those skilled in the art that evaporator package 30, compressor package 50 and condenser package 70 may include other valves and controls for the operation of ice cube-making machine 20.

Ice cube-making machines 20 and 25 of the present invention provide the advantage of lightweight packages for ease of installation. In most cases, a crane will not be needed. In addition, the evaporator package is rather quiet in operation, as the compressor and the condenser are remotely located. Finally, the distance between evaporator package 30 and condenser package 70 is greatly enhanced to approximately 70 feet in height from the 35 feet height constraint of the prior art two package system.

Figure 6:
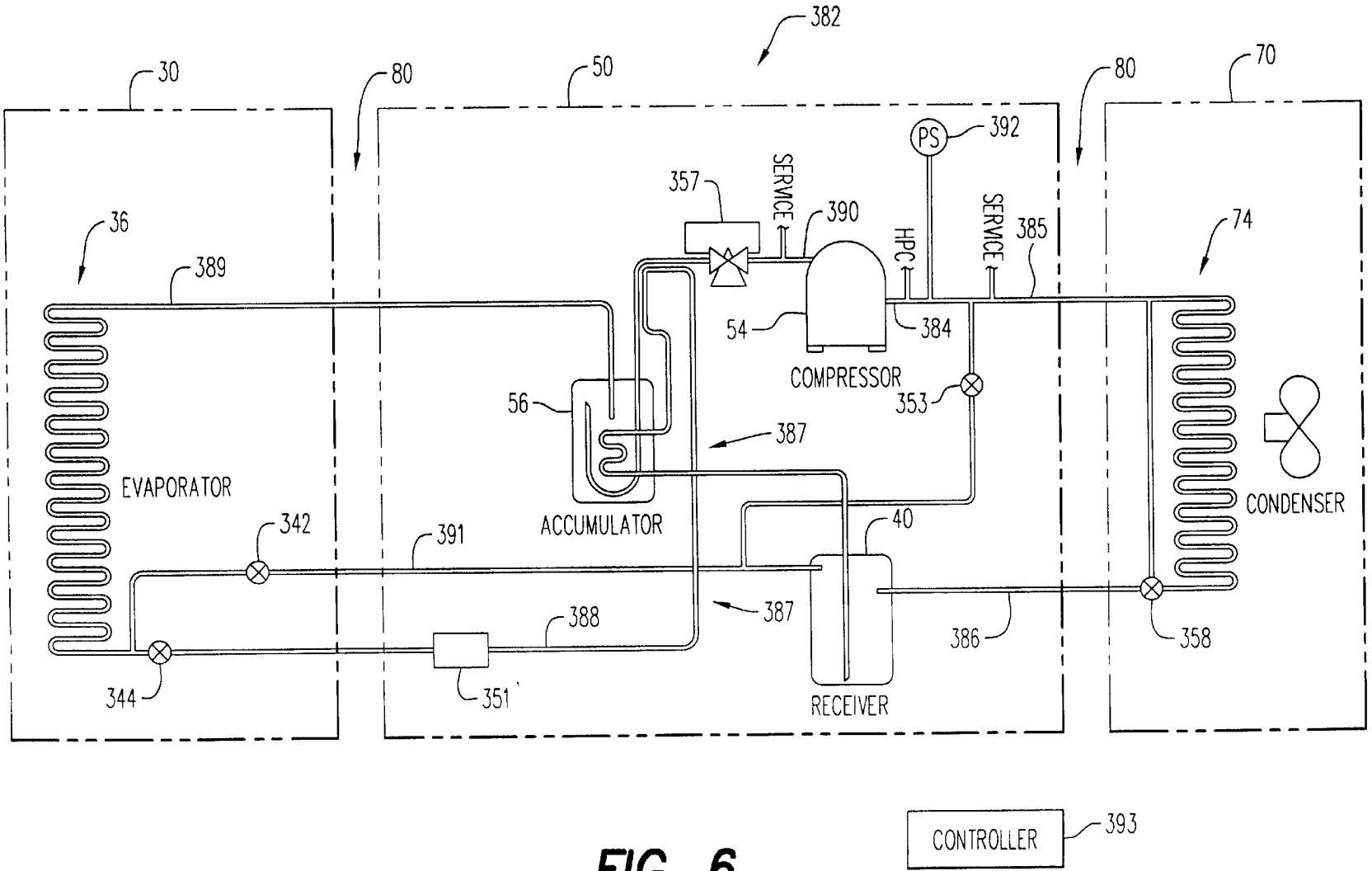
FIG. 6 is circuit diagram of another alternative refrigerant/warm gas circuit that can be used for the quiet ice-cube making machine of FIG. 1.

Referring to FIG. 6, a circuit 382 is shown that may be used with ice cube-making machine 20 of FIG. 1. Circuit 382 includes interconnection structure 80 that connects the components within compressor package 50 to the components within evaporator package 30 and to the components within condenser package 70. In evaporator package 30, evaporator 36 is connected in circuit 382 with a defrost or cool vapor valve 342 and an expansion valve 344. In compressor package 50, receiver 40, compressor 54 and accumulator 56 are connected in circuit 382 with a filter 351, a bypass valve 353, a head master or head pressure control valve 358 and an output pressure regulator 357. A heat exchanger loop 387 passes through accumulator 56 and is in thermal relationship with an output tube of accumulator 56 to optimize the use of liquid refrigerant in the accumulator during the freeze cycle.

It will be appreciated by those skilled in the art that evaporator package 30, compressor package 50 and condenser package 70 may include other valves and controls for the operation of ice cube-making machine 20. For example, ice-making machine 20 includes a controller 393 that controls the operations thereof including the activation of bypass solenoid valve 353 during the harvest cycle. Alternatively, a pressure switch 392 during harvest mode can activate solenoid valve 353.

According to a feature of the present invention output pressure valve 357 operates to raise pressure and temperature of the refrigerant in evaporator 36 during ice harvesting.

During a freeze cycle, cool vapor valve 342 and bypass valve 353 are closed and expansion valve 144 is open. Refrigerant flows from an output 384 of compressor 54 via a line 385, condenser 74, head pressure control valve 358 and a line 386 to receiver 40. Flow continues via heat exchanger loop 387, a supply line 388, filter 351, expansion valve 344, evaporator 36, a return line 389, accumulator 56, output pressure regulator 357 to an input 390 of compressor 54. Output pressure regulator 357 is wide open during the freeze cycle such that the refrigerant passes without any impact on flow.

During a harvest cycle, cool vapor valve 342 and bypass valve 353 are open and expansion valve 344 is closed. Refrigerant in vapor phase flows from the output of compressor 54 to a vapor line 391 via either or both of a first path that includes bypass valve 353 or a second path that includes head pressure valve 358 line 386 and receiver 40. Flow continues via vapor line 391, cool vapor valve 342, evaporator 36, return line 389, accumulator 56, output pressure regulator 357 to input 390 of compressor 54.

Output pressure regulator 357 operates during harvest to slow the flow and decrease pressure at input 390 to compressor 54. This results in a higher pressure in evaporator 36 and higher temperature of the vapor in evaporator 36. The higher temperature refrigerant in evaporator 36 enhances the harvest cycle.

The present invention having been thus described with particular reference to the preferred forms thereof, it will be obvious that various changes and modifications may be made therein without departing from the spirit and scope of the present invention as defined in the appended claims.

What is claimed is:

1. An ice-making machine comprising:

a condenser, a compressor and an evaporator, wherein said evaporator is located remotely of said condenser and said compressor;

a receiver; and a head pressure valve and a bypass valve connected in circuit with said compressor, said condenser, said evaporator and said receiver such that during a harvest cycle said receiver is either operable wherein said head pressure valve causes refrigerant to bypass said condenser so as to direct said refrigerant in vapor phase from said compressor to said receiver or said receiver is inoperable wherein said bypass valve causes said refrigerant to bypass said condenser and said receiver so as to direct said refrigerant from said compressor to said evaporator.

2. The ice-making machine of claim 1, further comprising a pressure switch, wherein said bypass valve is a solenoid valve activated during said harvest cycle by said pressure switch.

3. The ice-making machine of claim 1, further comprising a controller, wherein said bypass valve is a solenoid valve activated during said harvest cycle by said controller.

4. The ice-making machine of claim 1, further comprising a pressure regulator connected in circuit with said compressor and evaporator so as to limit flow of refrigerant from said evaporator to said compressor during said harvest cycle.

5. The ice-making machine of claim 1, further comprising an accumulator connected in circuit with said evaporator and said compressor and a heat exchanger disposed to optimize refrigerant in liquid phase in said accumulator during said freeze cycle.

6. The ice-making machine of claim 5, wherein said heat exchanger is a tube disposed in thermal relationship to an output line of said accumulator.

7. The ice-making machine of claim 5, wherein said heat exchanger is a tube disposed in thermal relationship with refrigerant inside said accumulator.

8. The ice-making machine of claim 1, wherein said condenser is located remotely from said compressor.

* * * * *